US010808920B2

(12) United States Patent
Baumeister et al.

(10) Patent No.: US 10,808,920 B2
(45) Date of Patent: Oct. 20, 2020

(54) CONNECTION ELEMENT

(71) Applicant: BJB GmbH & Co. KG, Arnsberg (DE)

(72) Inventors: Olaf Baumeister, Sundern (DE); Philipp Henrici, Arnsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 16/597,107

(22) Filed: Oct. 9, 2019

(65) Prior Publication Data

US 2020/0240623 A1 Jul. 30, 2020

(30) Foreign Application Priority Data

Jan. 29, 2019 (DE) ..... 10 2019 102 153

(51) Int. Cl.

| | |
|---|---|
| ***F21V 23/06*** | (2006.01) |
| ***F21S 4/28*** | (2016.01) |
| ***F21V 21/002*** | (2006.01) |
| ***H01R 4/2445*** | (2018.01) |
| ***H01R 13/717*** | (2006.01) |

(52) U.S. Cl.
CPC ..... *F21V 23/06* (2013.01); *F21S 4/28* (2016.01); *F21V 21/002* (2013.01); *H01R 4/2445* (2013.01); *H01R 13/7175* (2013.01)

(58) Field of Classification Search
CPC ..... F21V 23/06; F21V 21/002; F21S 4/28; H01R 4/2445; H01R 13/7175
See application file for complete search history.

(56) References Cited

U.S. PATENT DOCUMENTS

| | | | | |
|---|---|---|---|---|
| 3,831,131 A | | 8/1974 | Woodcock et al. | |
| 3,953,101 A | | 4/1976 | Palecek | |
| 4,410,222 A | * | 10/1983 | Enomoto | H01R 12/79 439/157 |
| 5,757,909 A | | 5/1998 | Park | |
| 6,081,431 A | * | 6/2000 | Lemke | H05K 9/002 361/754 |
| 6,544,061 B1 | * | 4/2003 | Yasufuku | H01R 13/631 439/310 |
| 6,672,898 B2 | | 1/2004 | Kahle et al. | |

(Continued)

*Primary Examiner* — Mary Ellen Bowman
(74) *Attorney, Agent, or Firm* — Von Rohrscheit Patents

(57) ABSTRACT

A connection element for a circuit board that includes electronic components or LED illuminants on a top side and that includes contact fields on a bottom side which are used at least for supplying electrical voltage to the electronic components that are arranged on the circuit board, the connection element including a receiving element that includes a contact surface for the circuit board and pressure contacts configured to contact the contact fields of the circuit board and connection contacts configured to connect connection conductors that provide electrical voltage; and a cover element that supports the circuit board on the receiving element, wherein the cover element is arranged at the receiving element and pivotable about a pivot axis, wherein the cover element is movable between an open position and a closed position, wherein the cover element facilitates a placement of the circuit board onto the contact surface of the receiving element in the open position of the cover element, and wherein the cover element supports the circuit board between the cover element and the receiving element in the closed position of the cover element.

10 Claims, 8 Drawing Sheets

(56) References Cited

U.S. PATENT DOCUMENTS

| | | | | |
|---|---|---|---|---|
| 6,722,909 | B1 * | 4/2004 | McHugh | H05K 7/1007<br>439/331 |
| 2006/0163601 | A1 * | 7/2006 | Harle | H01L 33/486<br>257/100 |
| 2008/0032532 | A1 * | 2/2008 | Tsai | H01R 12/88<br>439/160 |

* cited by examiner

CONNECTION ELEMENT

RELATED APPLICATIONS

This application claims priority from German patent application DE 10 2019 102 153.7, filed on Jan. 29, 2019.

FIELD OF THE INVENTION

The invention relates to a connection element for a circuit board that includes electronic components, in particular LED lights.

BACKGROUND OF THE INVENTION

A generic connection element is disclosed e.g. in WO 2017/210 253 A1. The connection element is used for connecting LED lights that are arranged on a carrier material, in particular a strip shaped metal core circuit board. Strip shaped LED circuit boards of this type are being used increasingly to replace florescent tubes. Typically line lamps for illuminating large spaces like hangars are produced this way. Line lamps, however, are also being used in other rooms like e.g. offices.

Though lamps using LED technology have a greater service life than e.g. fluorescent tubes, they are typically used in areas where the average burn time is very high. Therefore there is a need in spite of the high service life to replace also LED line lamps after a complete or partial failure.

This replacement is certainly possible using the known connection element recited supra since the receiving element and the cover element are connected with each other by a disengageable threaded connection. Initial mounting and replacement, however, are comparatively uncomfortable. The prior art lamps also have the disadvantage that they are not integratable into a lamp housing without great complexity.

BRIEF SUMMARY OF THE INVENTION

Thus, it is an object of the invention to provide a connection element for circuit boards, in particular for strip shaped LED lamps based on a metal core circuit board which facilitates simple installation and replacement of the circuit board as well as simple integration into a light housing.

The object is achieved by a connection element for a circuit board that includes electronic components or LED illuminants on a top side and that includes contact fields on a bottom side which are used at least for supplying electrical voltage to the electronic components that are arranged on the circuit board, the connection element including a receiving element that includes a contact surface for the circuit board and pressure contacts configured to contact the contact fields of the circuit board and connection contacts configured to connect connection conductors that provide electrical voltage; and a cover element that supports the circuit board on the receiving element, wherein the cover element is arranged at the receiving element and pivotable about a pivot axis, wherein the cover element is movable between an open position and a closed position, wherein the cover element facilitates a placement of the circuit board onto the contact surface of the receiving element in the open position of the cover element, and wherein the cover element supports the circuit board between the cover element and the receiving element in the closed position of the cover element.

It is a significant advantage of the invention that the cover element is arranged at the receiving element as a matter of principle and movable in this arranged position between an open position and a closed position. In the open position the circuit board can be inserted with its connection portion into the connection element. The cover element is then moved into the closed position which does not only facilitate electrical contacting but also provides mechanical fixation of the circuit board in the connection element.

It is particularly advantageous when a change between the open position and the closed position facilitates an installation without tools or a replacement of the circuit board without tools.

In an advantageous embodiment the cover element that is arranged at the receiving element is pivotable between an open position and a closed position. A linear movement, thus a sliding movement between the open position and the closed position, however, is possible as well.

It is advantageous when the cover element is fixable in its open position so that it is secured against vibration. This facilitates delivering the connection element ready to mount, thus in open position to a light production line. This furthermore facilitates to prepare the light ready to insert a circuit board into the light housing, in particular a strip shaped LED line lamp.

In order to ensure electrical contacting the cover element is provided with at least one contact pressure spring by which the circuit board is preloaded against the receiving element.

Additionally fabrication tolerances e.g. thickness tolerances of the circuit board can be compensated by the contact pressure spring. Also fabrication tolerances of the receiving portion of the connection element for the circuit board between the receiving element and the cover element can be compensated quite well in this manner. Last not least the contact pressure spring can improve the mechanical support of the circuit board by supporting the circuit board in the positioning and/or retaining contours.

Electrical contact is assured in particular when the spring force of the contact pressure spring is greater than the opposite forces of the pressure contacts of the receiving element.

Additionally the ratio of the opposite spring forces of contact pressure spring and pressure contacts assure that the circuit board reliably contacts the contact surface of the receiving element. This provides a safe support of the circuit board in the connection element and thus a safe mechanical fixing.

The mechanical fixing is additionally provided in that the receiving element or the cover element includes positioning contours and support contours that cooperate with opposite contours of the circuit board. Thus, the positioning and support contours can be configured as separate contours, thus contours with a positioning function and contours with a retaining function. The positioning and retaining contours, however, can also be combined in a component which provides positioning and mechanical support.

It is furthermore provided that the cover element includes at least one interlocking device and that the cover element includes a corresponding interlocking contour, wherein the interlocking device and the interlocking contour cooperate in a closed position of the cover element and retain the cover element in the closed position.

This way it is assured that the cover element remains in the closed position and does not only provide a reliable function when the light is mounted but also facilitates a preassembly of the lamp in the light before a transportation from a manufacturer to a customer.

In the instant embodiment it is provided that the cover element is a cover bar with two parallel arms that support contact pressure springs that originate from a portion of the cover element that is proximal to the pivot axis and that are oriented orthogonal to the pivot axis.

Thus, it is provided that both arms are connected with each other by a bridge that is parallel to the pivot axis. The bridge that is parallel to the pivot axis supports an interlocking element e.g. an interlocking bar that facilitates interlocking the cover element in an open position at the receiving element so that a defined permanent open position is assured.

It is furthermore provided that the spring arms are offset from each other and that a receiving space for electronic components and/or optics of the circuit board is provided between the spring arms.

These features assure that plural lights that use the connection element according to the element can be arranged behind one another without causing areas with insufficient illumination at a transition from one light to the other. Put differently the receiving space in the connection element provides a direct joining of the line lamp at the face end of the light housing when the light housing is configured accordingly.

In order to optimize the electrical contacting between the circuit board and the connection element or the pressure contacts of the connection element and the contact fields of the circuit board a geometric axis is provided that is oriented along the contact pressure buds of the pressure contacts and that divides the contact element into a section that is proximal to the pivot axis and a section that is remote from the pivot axis and wherein a contact section of each contact pressure spring is arranged on the geometric axis or in a section of the contact element that is remote from the pivot axis.

It is furthermore provided that the interlocking device of the cover element is an interlocking arm and the interlocking contour of the receiving element is formed by an interlocking recess or an interlocking protrusion. It is particular advantageous when the interlocking force of the interlocking arm is oriented transversal to the spring force of the contact pressure spring.

The orientation of the spring force of the interlocking arm transversal to the contact pressure spring has the essential advantage of being force neutral with respect to the spring force pairing between the contact pressure spring and the pressure contacts.

In a particularly advantageous embodiment the spring force of the interlocking arm can increase the spring force of the contact pressure springs. This is also possible when an interlocking force of the interlocking arm is oriented transversal to a spring force of the contact pressure spring when the interlocking force pulls the cover element towards the circuit board due to a cooperation with the interlocking protrusion at the receiving element.

It is furthermore provided that the interlocking arm is provided with a disengagement bar that facilitates disengaging the interlocking protrusion between the cover element and the receiving element.

This way it is possible in a simple manner to move the disengagement bar which forms the cover element from an interlocking closed position into an open position.

It is also provided that the connection element includes interlocking safety devices that facilitates fixing the connection element in a recess of a light housing.

The object is also achieved by a light including the connection element described supra which provides an additional substantial advantage through the additional feature according to which the contact surface of the connection element and the receiving surface of the lamp element are arranged in a common plane.

The arrangement in the common plane has the advantage that the circuit board is not only supported in the connection element but also at the light element. This improves mechanical stability and facilitates to configure the light element as a heat dissipating component if required. This is particularly advantageous when the circuit board is a metal core circuit board that absorbs operational heat from LED illuminants and dissipates the operational heat. This is typically required for particularly powerful LED's in order to achieve sufficient service life.

BRIEF DESCRIPTION OF THE DRAWINGS

Additional advantages of the invention can be derived from the subsequent description of an advantageous embodiment with reference to drawing figures, wherein.

DETAILED DESCRIPTION OF THE INVENTION

Figure 1:
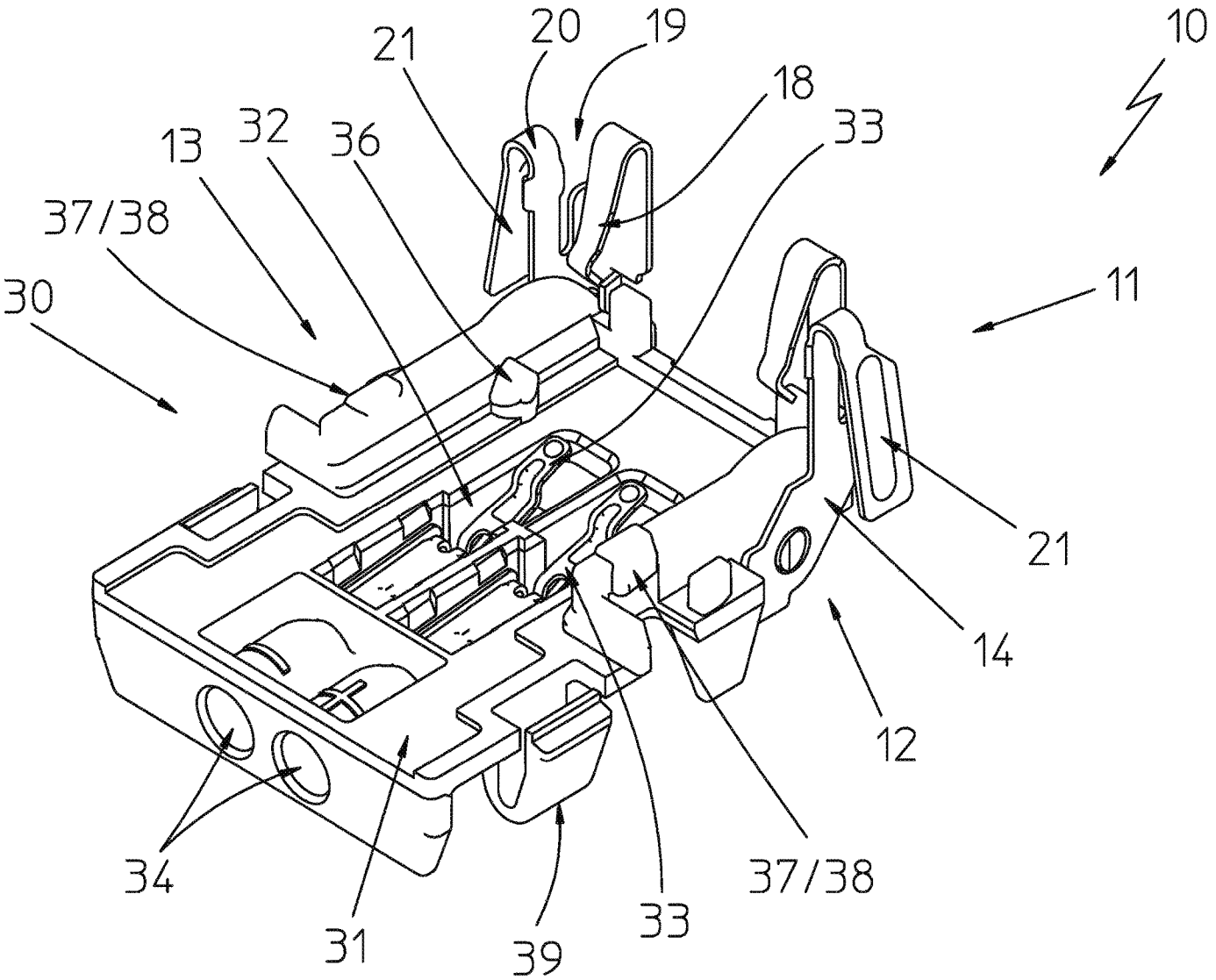
FIG. 1 illustrates an embodiment of the connection element according to the invention in a perspective top view.

In the drawing figures the connection element according to the invention is designated overall with the reference numeral 10.

The connection element 10 is now described with reference to its structure based on FIGS. 1 and 2. The connection element includes a cover element 11 configured as a pivotable approximately a U-shaped bar 12 that is arranged at a receiving element 13 and pivotable about a geometric axis S and configured to receive the circuit board.

The U-shaped bar 12 includes two arms 14 that are oriented orthogonal to the pivot axis S wherein the ends of the arms that are oriented proximal to the pivot axis are connected with each other by a bridge 15 that is oriented parallel to the pivot axis. The arms 14 are furthermore provided with shaft openings 16 that are configured to receive stub shafts 17 that are formed by the receiving element 13. The stub shafts 17 form the physical pivot axis of the connection element 10.

The free ends of the arms 14 are formed into contact pressure springs 18 by bending in a direction towards the receiving element 13. The arms 15 furthermore support interlocking devices 19 at the cover element configured as interlocking arms 20 which are provided with disengagement bars 21. The interlocking arms 20 facilitate locking the bar 12 in a closed position. The locking can be released by the disengagement bars 21.

Figure 2:
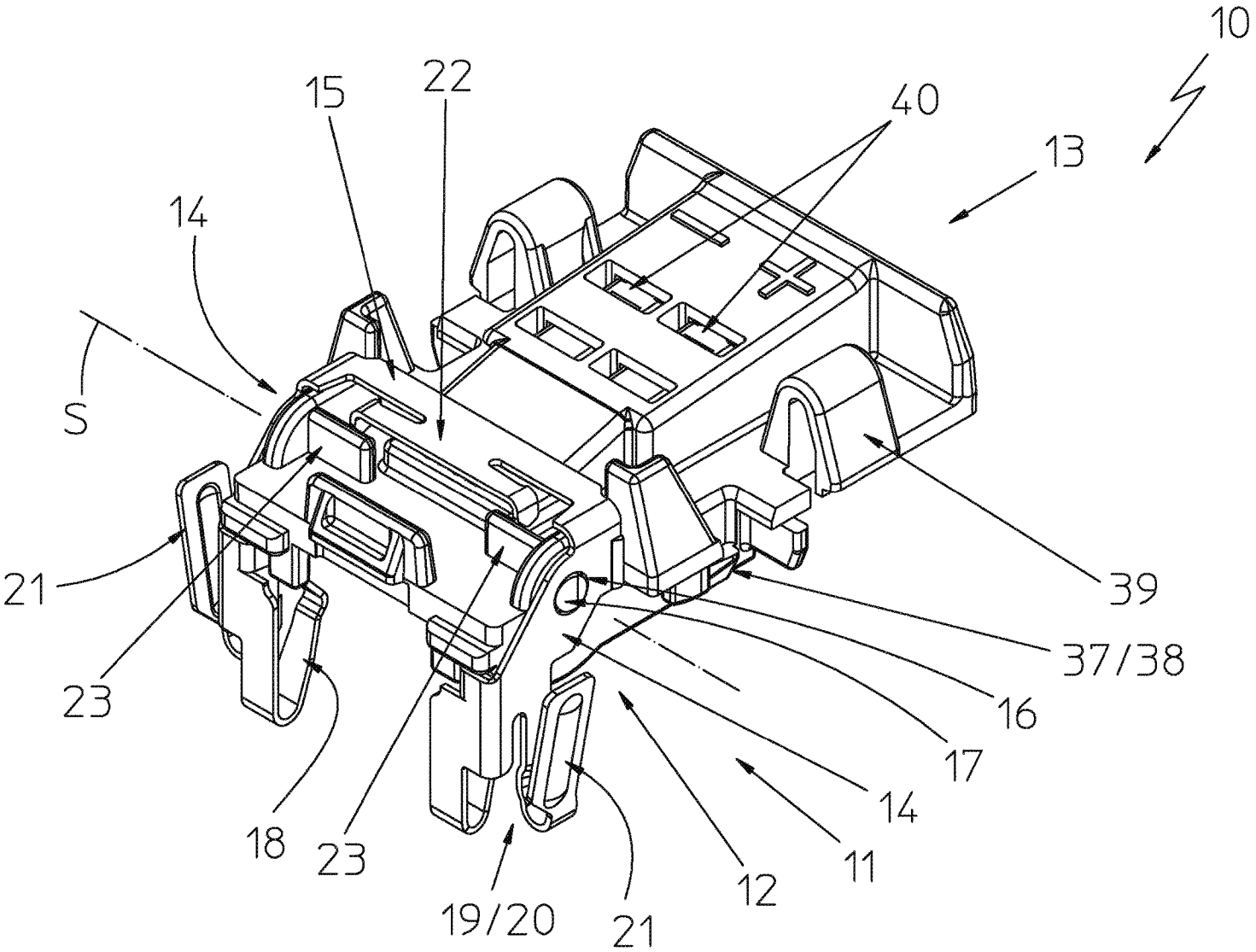
FIG. 2 illustrates a connection element according to FIG. 1 in a perspective view from below.

The bridge 15 which is in particular clearly visible in FIG. 2 supports a locking bar 22 that cooperates with interlocking blocks 23 which are arranged at the receiving element and that locks the cover element 11 in the open position.

Thus, the cover element 11 cooperates with the receiving element 13 of the connection element 10. The receiving element 13 includes a housing body 30 that forms a contact surface 31 on its top side wherein the contact surface provides support for a circuit board 10. Contact recesses 32 are recessed in the support surface 31 and pressure contacts 33 are inserted into the contact recesses 32. The pressure contacts furthermore include non-illustrated clamping locations that are accessible for the stripped ends of a contact conductor through contact conductor openings 34 of the housing element 30. Positioning and support contours 35 protrude from the contact surface 31, thus configured as two opposite positioning and retaining mandrels 36 of which only one is illustrated. Laterally protruding interlocking contours 37 configured as interlocking protrusions 38 cooperate with the interlocking devices 19 of the cover element 11 in order to secure the cover element in the closed position.

Last not least the cover element 13 includes locking bars 39 that facilitate a reliable anchoring of the receiving element in a recess of the light element 50. Tool openings 40 on a bottom side facilitate opening clamping locations of the pressure contacts 33 and thus disengaging the conductor ends inserted at this location.

Figure 3:
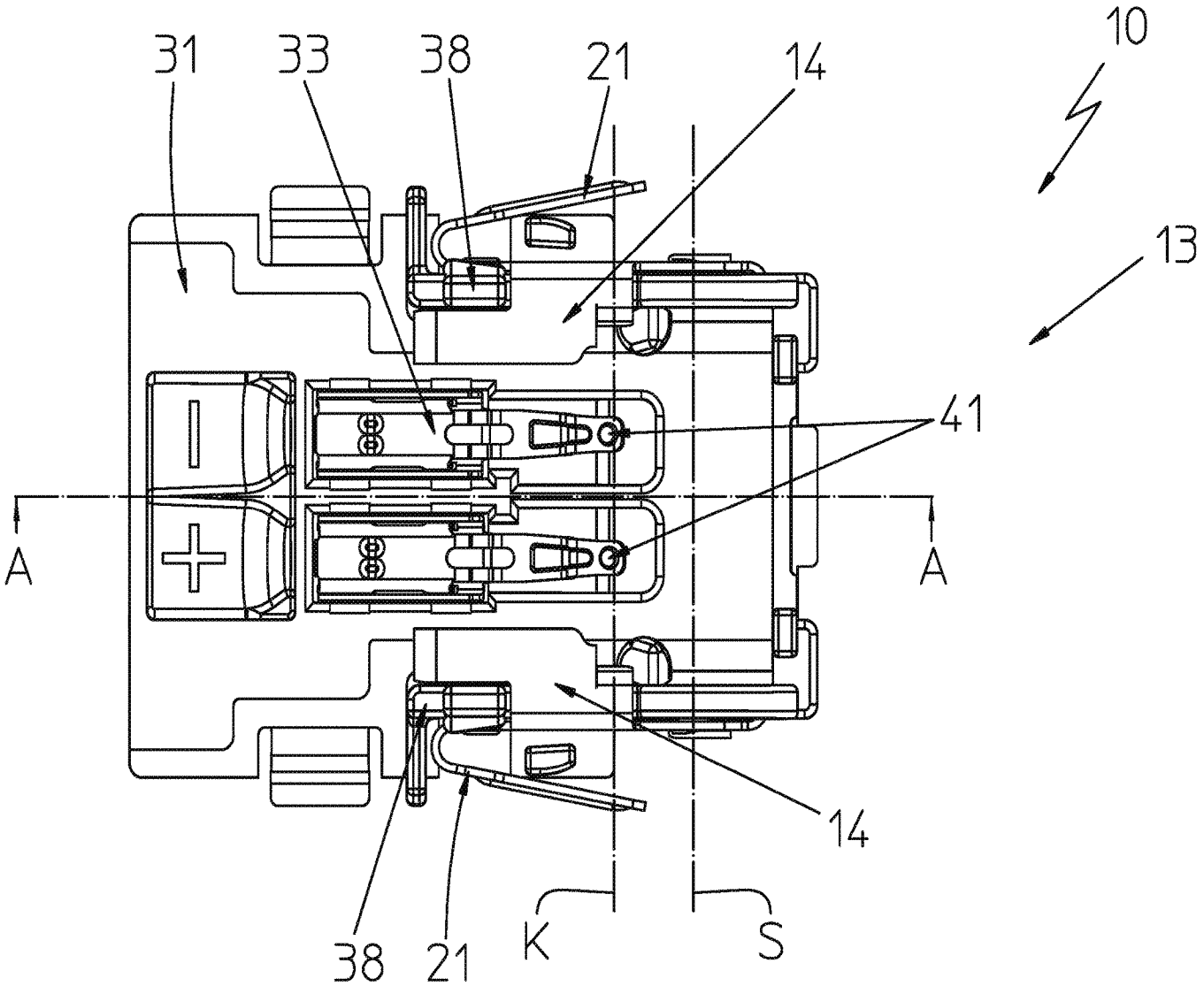
FIG. 3 illustrates a view of a contact surface of the connection element according to the invention with the cover element in the closed position.
Figure 4:
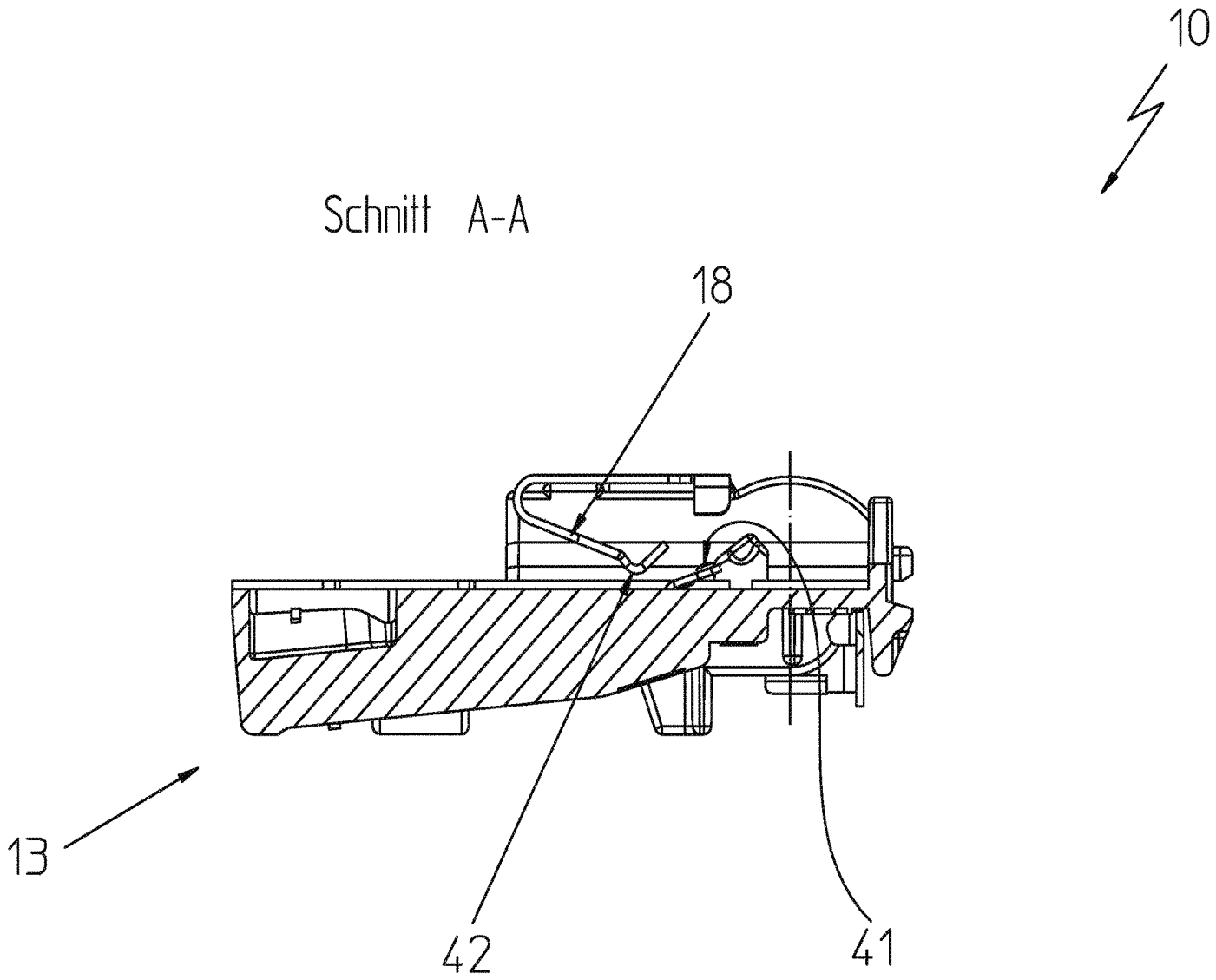
FIG. 4 illustrates a sectional view according to sectional line A-A in FIG. 3.
Figure 5:
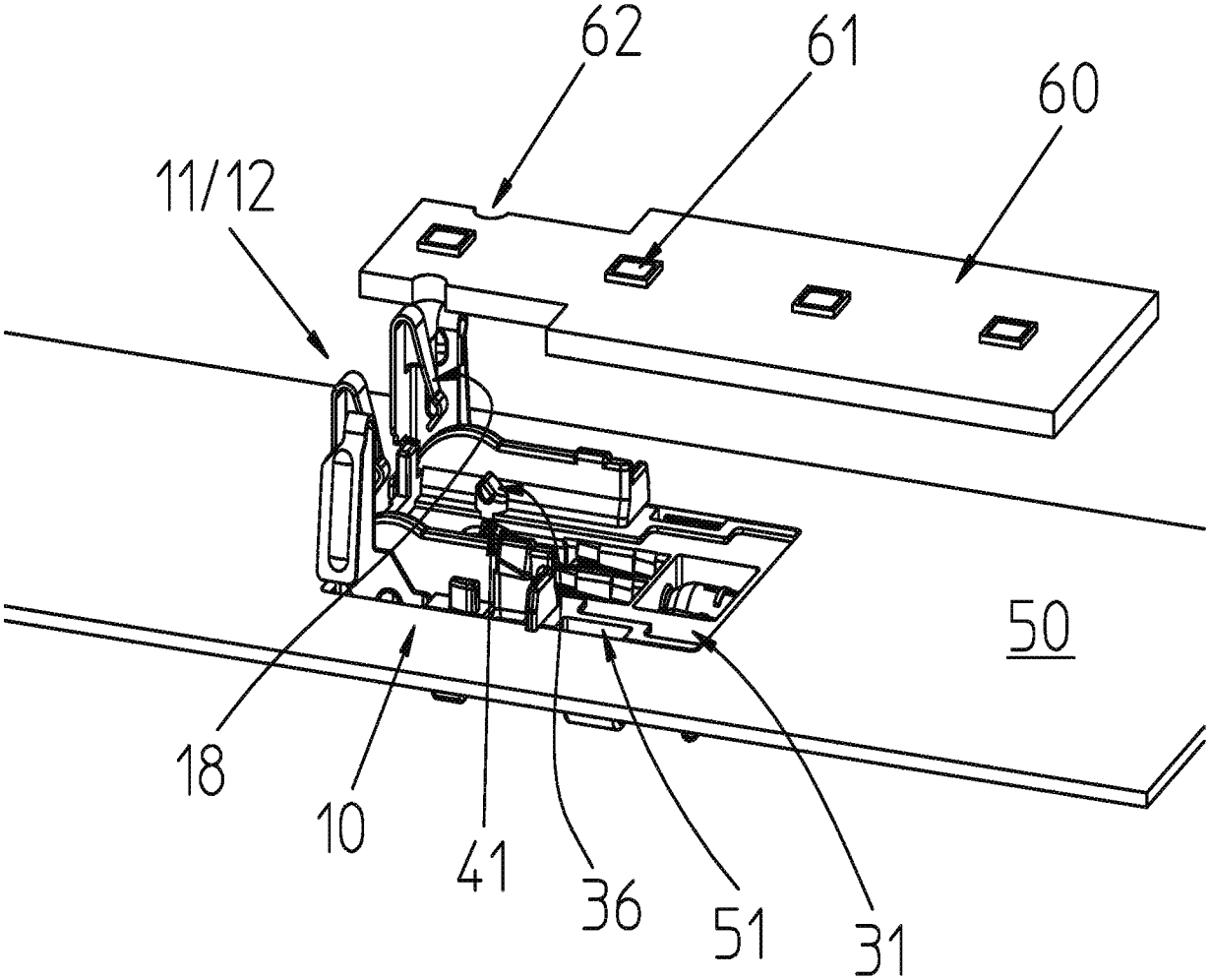
FIG. 5 illustrates a functional pairing of the connection element, the light element and the circuit board before insertion.
Figure 6:
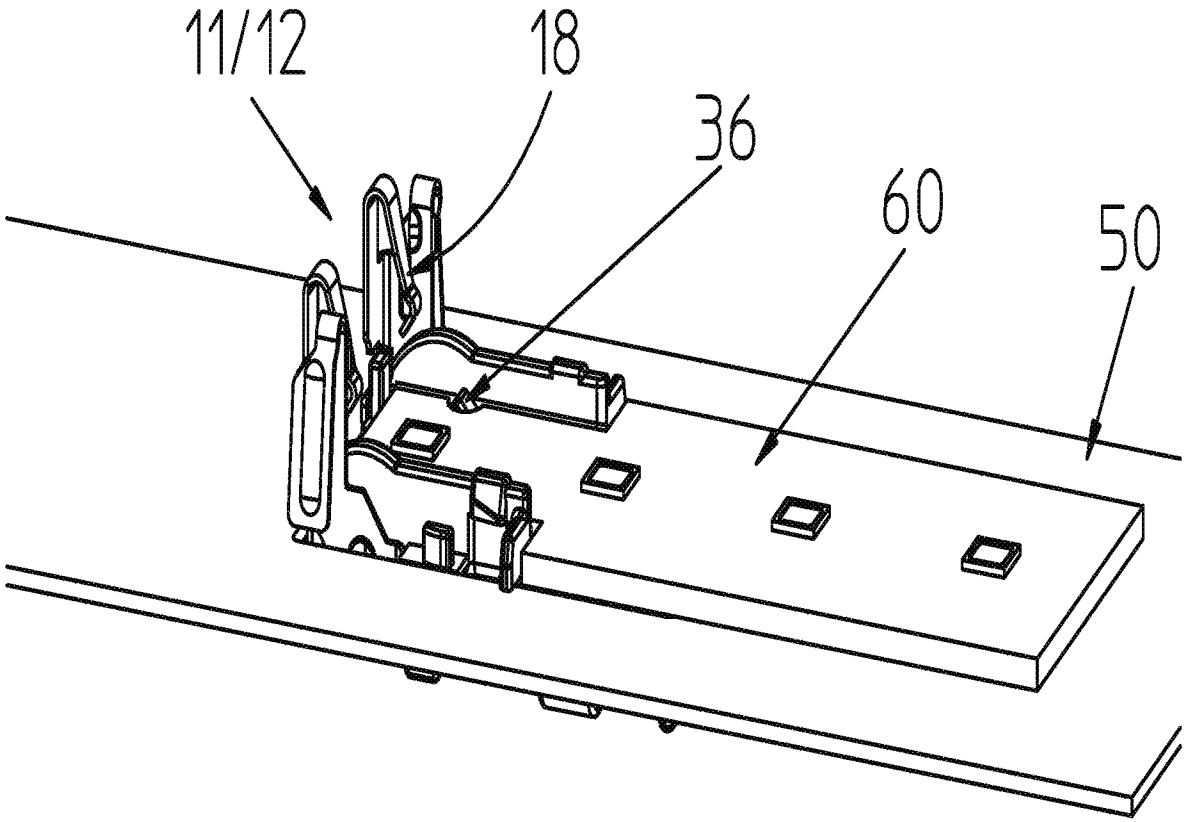
FIG. 6 illustrates the functional pairing according to FIG. 5 with inserted circuit board with cover element in the open position.
Figure 7:
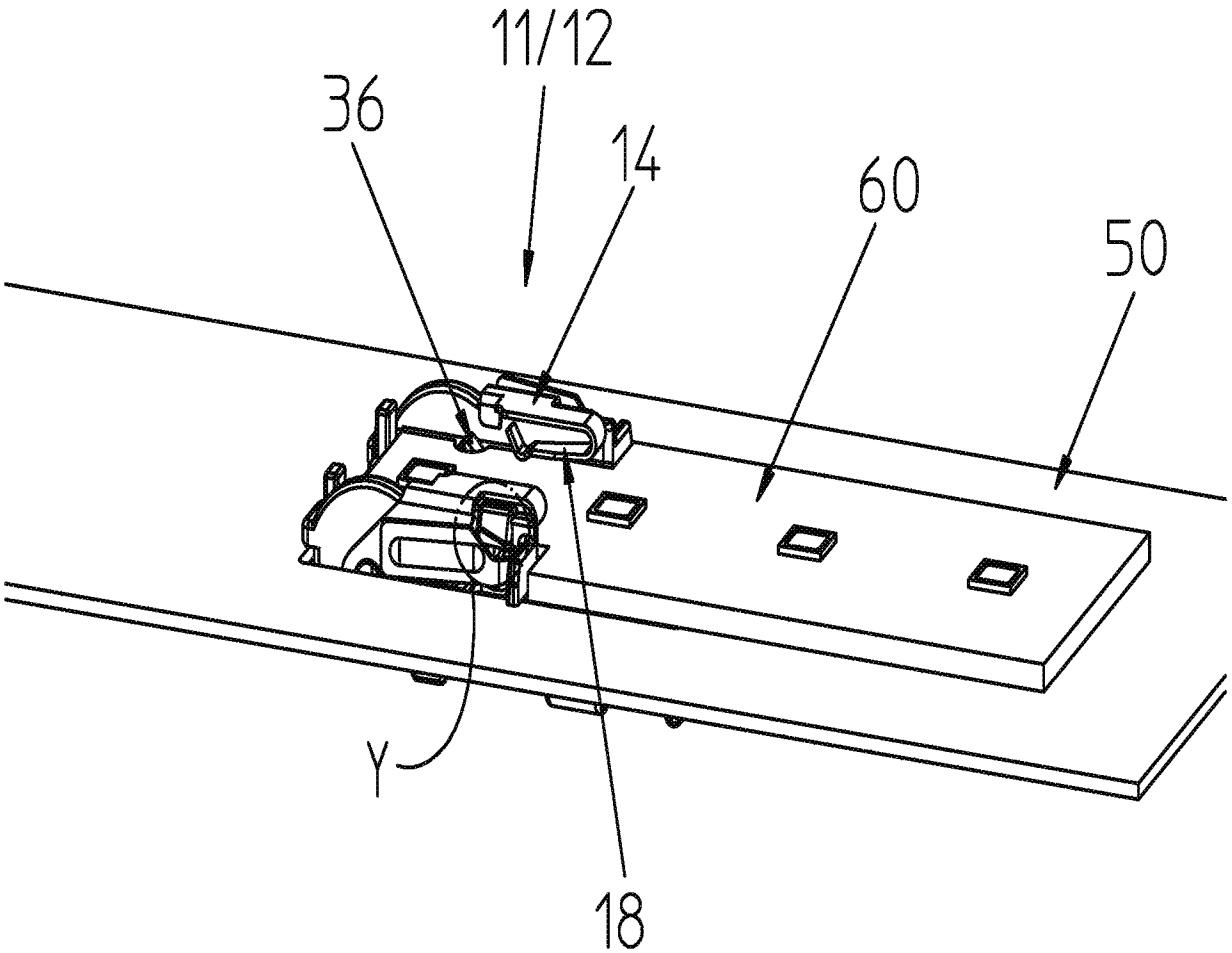
FIG. 7 illustrates the functional pairing according to FIG. 6 with the cover element in the closed position.
Figure 8:
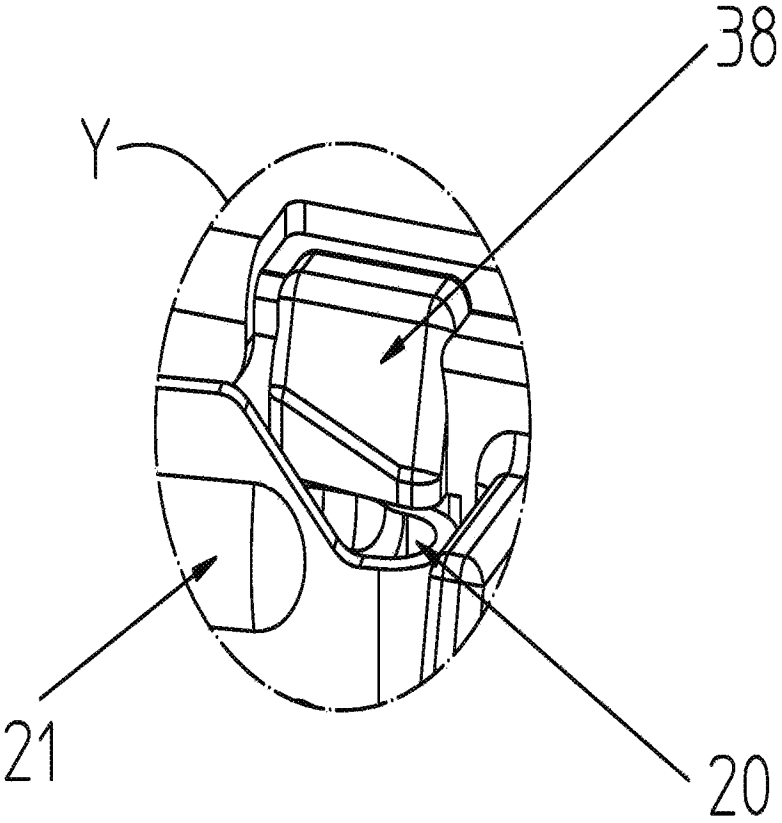
FIG. 8 illustrates a detail view of the detail circle Y in FIG. 7.

FIG. 3 illustrates the connection element 10 according to the invention in a top view with the cover element 11 in a closed position. FIG. 4 illustrates a sectional view according to the sectional line A-A in FIG. 3.

FIG. 3 illustrates that the pressure contacts 33 respectively form a contact bud 41 wherein the contact buds are arranged on a common geometric axis K. The axis K divides the receiving element 13 in to a portion that is proximal to the pivot axis S and a portion that is remote from the pivot axis S. The contact section 42 of each contact spring 18 is arranged in the portion of the receiving element 13 that is remote from the pivot axis in the illustrated embodiment.

The functional pairing of a light element 50 and of the connection element 10 according to the invention during insertion of a circuit board 60 configured as a LED line lamp is now described with reference to FIGS. 5-8.

The light element 50 is schematically illustrated as a sheet metal strip with a recess 51. The surface of the light element 50 that is oriented towards the circuit board 60 is used as a receiving surface on which the circuit board 60 is configured to contact with its bottom side.

The connection element 10 according to the invention is arranged in the recess 51, wherein the contact surface 31 of the receiving element 13 is oriented in the same plane with the receiving surface of the light element.

The circuit board 60 is provided with a plurality of LEDs 61 on its top side, wherein the LED's 61 are arranged in series behind one another. The circuit board 60 is an elongated strip thus made e.g. from a suitable carrier metal like aluminum that is provided with an insulation layer on which the LED 61, non-illustrated conductive paths and required additional electronic components are arranged. In addition to these circuit boards also designated as metal core circuit boards all other types of circuit board materials are suitable.

It is not illustrated that the conductive paths that are arranged on a top side of the circuit board 60 and connect the LEDs with one another are run at a connection side end of the circuit board 60 to a bottom side of the circuit board and form contact fields at this location that cooperate with the pressure contacts 33. The conductive paths can be run to the bottom side through a pressure contact. By the same token it is possible to imprint the bottom side with the conductive paths accordingly. It is also conceivable that a foil conductor is attached at a receiving element side end of the circuit board 60 on a top side wherein the foil conductor is then folded over and contacts the bottom side.

The circuit board 60 is then applied to the light element 50. The connection element side end of the circuit board 60 then contacts the contact surface 31 of the connection element 10. The contact buds 41 of the pressure contacts 33 come into electrical contact with the non-illustrated contact fields on a bottom side of the circuit board 60 so that a voltage supply of the LEDs and optionally of additional electronic components of the circuit board is assured.

Since the contact surface 31 and the receiving surface of the light element 50 are arranged at the same level the circuit board contacts the light element 50 in a mechanically stable manner with its entire surface. This is advantageous in particular for very elongated circuit boards 60, so called LED line lamps. In addition to providing mechanical stability this contact of circuit board 60 and light element 50 also provides advantageous heat dissipation in particular when the light element 50 is configured as a cooling element.

Going beyond a particular circuit board size additional attachment devices can be advantageous for fixing at the light element depending on stiffness of the circuit board.

The contact pressure springs 18 of the arms 14 of the cover element 11 are thus placed onto a top side of the circuit board 60 and loaded with a spring force that impacts the circuit board 60 when moved into the closed position of the cover element 11. This spring force is oriented against a spring force of the pressure contacts 33 which assures a reliable contact of the contact buds 41 at the non-illustrated contact fields of the circuit board 60. The locking arms 20 reach behind the locking protrusions 38 of the receiving element 13 in the closed position and thus secure the closed position of the cover element 11. The positioning and support mandrels 36 of which only one is illustrated engage corresponding positioning and support recesses 62 of the circuit board 60 and secure a correct position of the circuit board in the receiving element and secure the circuit board in the receiving element mechanically in a permanent manner.

REFERENCE NUMERALS AND DESIGNATIONS

10 connection element
11 cover element
12 bar
13 receiving element
14 arm
15 bridge
16 shaft opening
17 stub shaft
18 contact pressure spring
19 interlocking device
20 interlocking arm
21 disengagement bar
22 interlocking bar

23 interlocking block
30 housing body
31 contact surface
32 contact recess
33 pressure contact
34 connection conductor opening
35 positioning and support contour
36 positioning and support mandrel
37 interlocking contour
38 interlocking protrusion
39 interlocking bar
40 tool opening
41 contact bud
42 contact section
50 light element
51 recess
60 circuit board
61 LED
62 positioning and support recess
S pivot axis
K geometric axis

What is claimed is:

1. A connection element for a circuit board that includes a strip shaped LED lamp on a top side and that includes contact fields on a bottom side which are used at least for supplying electrical voltage to the electronic components that are arranged on the circuit board, the connection element comprising:

a receiving element that includes a contact surface for the circuit board and pressure contacts with contact buds configured to contact the contact fields of the circuit board and connection contacts configured to connect connection conductors that provide electrical voltage; and a cover element that supports the circuit board on the receiving element, wherein the cover element is arranged at the receiving element and pivotable about a pivot axis between an open position and a closed position, wherein the cover element facilitates a placement of the circuit board onto the contact surface of the receiving element in the open position of the cover element, and wherein the cover element supports the circuit board between the cover element and the receiving element in the closed position of the cover element, wherein the cover element includes at least one contact pressure wring that pivots with the cover element and the circuit board is preloaded directly by the at least one contact pressure spring directly against the receiving element in the closed position of the cover element, wherein the cover element is a cover bar with two parallel arms that support the at least one contact pressure spring and that originate from a portion of the cover element that is proximal to the pivot axis and that are oriented orthogonal to the pivot axis, wherein a geometric axis is provided parallel to the pivot axis and arranged along the contact buds of the pressure contacts configured to contact the circuit board so that the geometric axis divides the receiving element into a section that is proximal to the pivot axis and a section that is remote from the pivot axis, and wherein a contact section of the at least one contact pressure spring at the circuit board is arranged in the section of the receiving element that is remote from the pivot axis when the cover element is in the closed position.

2. The connection element according to claim 1, wherein a spring force of the contact pressure spring is greater than opposite forces of the pressure contacts of the receiving element.

3. The connection element according to claim 1, wherein the cover element includes at least one interlocking device and the receiving element includes a corresponding interlocking contour, and wherein the interlocking device and the interlocking contour cooperate in a closed position of the cover element and support the cover element in the closed position.

4. The connection element according to claim 1, wherein the receiving element or the cover element include positioning and support contours that cooperate with opposite contours of the circuit board.

5. The connection element according to claim 1, wherein the arms are offset from each other and a receiving space for electronic components or optics of the circuit board is provided between the arms.

6. The connection element according to claim 3, wherein the at least one interlocking device of the cover element is an interlocking arm and the locking contour of the receiving element is formed by a receiving recess or by a receiving protrusion.

7. The connection element according to claim 1, wherein the at least one interlocking device of the cover element is an interlocking arm and the locking contour of the receiving element is formed by a receiving recess or by a receiving protrusion, and wherein a locking force of the interlocking arm is oriented transversal to the spring force of the at least one contact pressure spring.

8. The connection element according to claim 6, wherein the interlocking arm is provided with a disengagement bar that facilitates disengaging an interlocking between the cover element and the receiving element.

9. The connection element according to claim 1, wherein the connection element includes additional interlocking safety devices that facilitate fixing the connection element in a recess of the light housing.

10. A light element or light housing, comprising:

a receiving surface for a circuit board provided with a strip shaped LED lamp, wherein the receiving surface includes a recess configured to arrange the connection element according to claim 1, and wherein the contact surface of the connection element and the receiving surface of the light element are arranged in a common plane.

* * * * *